United States Patent [19]

Sendelbach

[11] Patent Number: 5,074,431

[45] Date of Patent: Dec. 24, 1991

[54] PAPER PLATE PANTRY

[76] Inventor: Herman E. Sendelbach, 5539 E. Charter Oak Rd., Scottsdale, Ariz. 85254

[21] Appl. No.: 508,585

[22] Filed: May 29, 1990

[51] Int. Cl.[5] ..... B65H 1/00

[52] U.S. Cl. ..... 221/45; 221/63; 221/283

[58] Field of Search ..... 221/45, 61, 63, 282–283, 221/303,309, 310

[56] References Cited

U.S. PATENT DOCUMENTS

| | | | |
|---|---|---|---|
| 1,762,948 | 6/1930 | Barbieri | 221/45 |
| 4,580,696 | 4/1986 | Moore, Jr. et al. | 221/61 |
| 4,643,334 | 2/1987 | Steele | 221/63 |
| 4,874,112 | 10/1989 | Mulder et al. | 221/63 |
| 4,930,662 | 6/1990 | Carillo | 221/63 |

*Primary Examiner*—H. Grant Skaggs
*Attorney, Agent, or Firm*—Harry M. Weiss

[57] ABSTRACT

A paper plate dispenser for use on a picnic table or for mounting on a wall of a cabinet. The dispenser includes a peripheral wall having an axis and having axially spaced first and second wall portions. The first wall portion has a plurality of mounting projections on the radially inner side thereof. The second wall portion has a radially inner flange surrounding an exit opening. The flange and a part of the adjacent wall portion have a cutout portion for manually gripping the axial end plates of a stack of plates within the dispenser and for flexing or warping the end plates and for drawing them axially out through the exit opening.

2 Claims, 1 Drawing Sheet

PAPER PLATE PANTRY

The invention generally relates to a paper plate dispenser and method, and, in particular, the invention relates to a paper plate dispenser and method having an end peripheral wall portion with a 300 degree arcuate flange and having an opposite end peripheral wall portion with inner mounting projection to facilitate downward withdrawal of one or more paper plates.

BACKGROUND OF THE INVENTION

A prior art paper plate dispenser is described in U.S. Pat. No. 4,930,662, issued June 5, 1990. Related patents include U.S. Pat. Nos. 4,874,112, issued Oct. 17, 1989, and 4,653,342, issued Feb. 17, 1987, and 4,643,334, issued Feb. 17, 1987 and 4,580,696, issued Apr. 8, 1986, and 4,550,856, issued Nov. 5, 1985, and 4,094,443, issued June 13, 1978, and 3,930,698, issued Jan. 6, 1976, and 3,338,646, issued Aug. 29, 1967, and 2,496,812, issued Feb. 7, 1950, and 2,358,709, issued Sept. 19, 1944, and 2,115,923, issued May 3, 1938, and 1,762,948, issued June 10, 1930.

The prior art paper plate dispenser disclosed in U.S. Pat. No. 4,930,662 includes a two-piece container for flexible plates having a cylindrical bottom aperture, a peripheral flange formed about a substantial portion of the bottom aperture to provide a guide surface for sliding selected bottom ones of the plates radially outward from the container, and at least one tab formed at the bottom aperture disposed between opposite ends of the flange, wherein bottom ones of the flexible plates can be manually grasped adjacent the tab and be warped and be slid radially outward along a guide surface of the peripheral flange.

One problem with the prior art dispenser is that the dispenser requires an adjacent radial clearance or space for sliding the plates radially outward parallel to its mounting surface. Another problem is that it is relatively difficult to affix the dispenser to a mounting surface and then to assemble the two-piece dispenser.

SUMMARY OF THE INVENTION

It is an object of this invention to provide an improved paper plate dispenser and method. It is another object of this invention to provide an improved paper plate dispenser and method which facilitates removal of paper plates from the bottom of the dispenser. One further object of the present invention is to provide a paper plate dispenser and method which avoids the need for a radial clearance or space adjacent to a dispenser for taking out a paper plate from the dispenser.

Another object of the invention is to provide a paper plate dispenser and method which avoids the difficulty of mounting a portion of a dispenser on a mounting surface and then assembling the remaining dispenser parts.

The foregoing and other objects, features and advantages will be apparent from the following description of the preferred embodiment of the invention as illustrated in the accompanying drawings.

BRIEF DESCRIPTION OF THE PREFERRED EMBODIMENT

According the to present invention, a paper plate dispenser is provided. This dispenser comprises a peripheral wall having an axis and having first and second axially spaced wall portions, the first wall portion having a plurality of radially inner projections for mounting the dispenser, the second wall portion having a generally cylindrical radially inner flange surrounding an exit opening, the flange having a cutout, the flange being generally defined by a 300 degree angle, the cutout being generally defined by a 60 degree angle, and the flange having at least one notched portion disposed axially opposite to a projection. By using the flange being generally defined by a 300 degree angle, the bottom ones of the plates can be flexed or warped and thereby pulled in an axial direction out through the bottom exit opening, whereby an adjacent radial clearance or space is not required. By using the notched portion disposed opposite to a projection, a driver tool is not blocked by the flange, and the difficulty of affixing the dispenser to a mounting surface is avoided and the assembling of the dispenser parts is avoided.

DESCRIPTION OF THE PREFERRED EMBODIMENT

Figure 1:
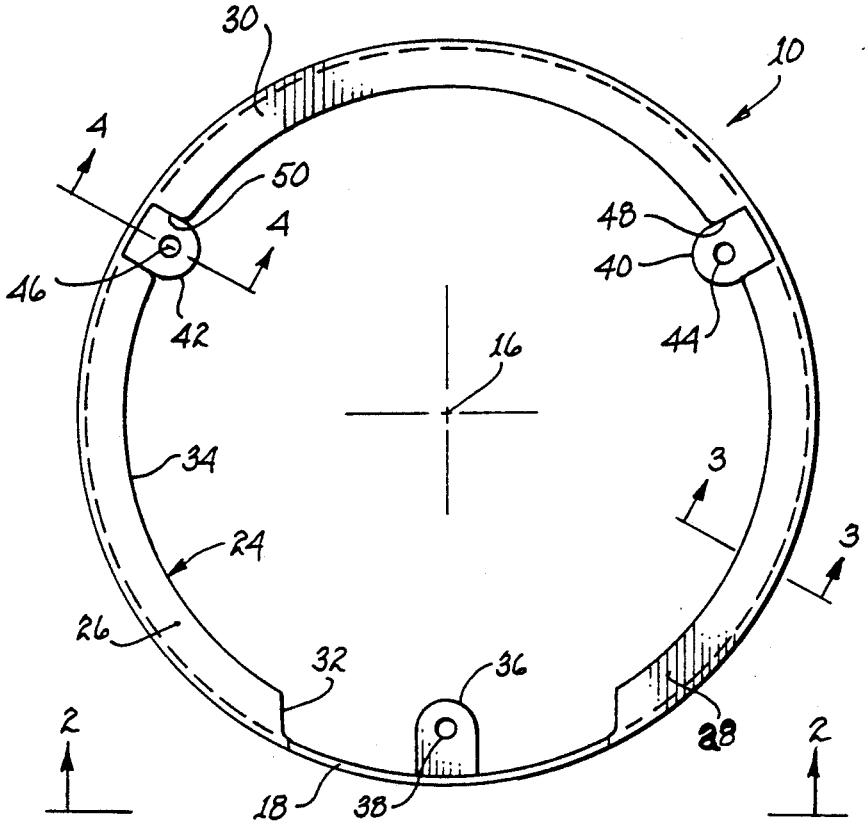
FIG. 1 is a plan view of a dispenser according to the invention.
Figure 2:
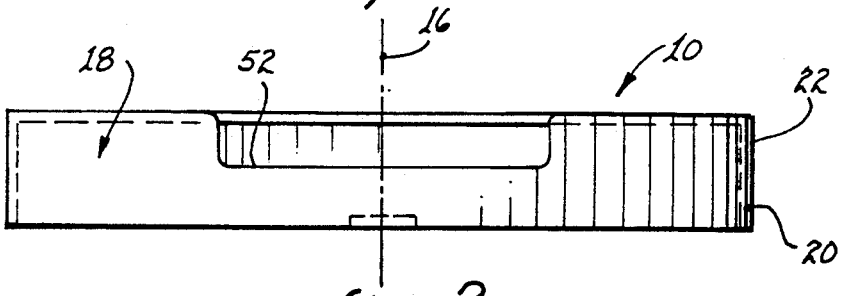
FIG. 2 is an elevation view as taken along the line 2—2 of FIG. 1.
Figure 3:
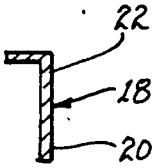
FIG. 3 is a section view as taken along the line 3—3 of FIG. 1.
Figure 4:
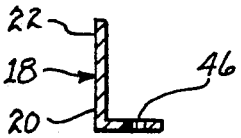
FIG. 4 is a section view as taken along the line 4—4 of FIG. 1.

As shown in 1 through 4, a paper plate dispenser 10 is provided. This dispenser 10 holds and encloses a stack of paper plates with an end plate for use on a kitchen table or a picnic table or for mounting on a kitchen cabinet or the like. Dispenser 10 has an axis 16 and has a peripheral wall 18, which has first and second axially spaced wall portions 20, 22. Second wall portion 22 has a circular flange 24, which has peripherally spaced flange portions 26, 28, 30. Flange 24 has a cutout 32, which is disposed between flange portions 26, 28. Flange 24 surrounds an opening 34, through which selected end plates of the stack can be pulled or withdrawn.

First wall portion 20 has a first projection or leg 36, which has a hole 38 for a screw or the like, and which is disposed axially opposite to recess 32. First wall portion 20 also has second and third projections 40, 42, which have respective holes 44, 46.

Second wall portion 22 also has two notch portions 48, 50 provide a clearance for a drive tool, or a screwdriver, or the like, for inserting connectors or screws into a mounting surface through holes 44, 46.

Peripheral wall 18 has a wall cutout 52, which is disposed adjacent to flange cutout 32 thereby forming an overall L-shaped cutout.

In use or operation, the end plate of the stack of plates can be gripped by the hand, or by the thumb and fingers and the end plate can be pulled through opening 34 away from flange 24 in an axial direction along axis 16. This operation can be done while dispenser 10 is lying flat on a kitchen or picnic table with the opening 34 facing upwards. Also, the operation can be done while dispenser 10 is mounted on the sidewall of a kitchen cabinet with the opening 34 facing sidewards. Thus, dispenser 10 does not require any radial clearance which is required by the prior art dispenser. Dispenser 10 requires only an axial clearance along axis 16 away from opening 34.

Dispenser 10 has advantages as indicated hereafter.

A) Dispenser 10 is suited for varied use, as on a picnic table or a kitchen table, or for mounting of the underside or on the sidewall of a cabinet.

B) As dispenser 10 does not require a radial clearance for sliding a plate therefrom in a radial direction, dispenser 10 can be mounted in more varied locations than the prior art dispenser.

C) One piece dispenser 10 avoids the difficulty of the prior art two piece dispenser in mounting the dispenser; and one-piece dispenser 10 does not require any parts assembly after installing its mounting screws.

D) Dispenser 10 avoids using post and hole connectors which are required in the prior art dispenser for connecting its first cylindrical container part to its second cylindrical mounting ring part. While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A flexible plate dispenser comprising:

a peripheral wall having an axis and having first and second axially spaced wall portions;

the first wall portion having at least one radially inner projection for mounting the dispenser;

the second wall portion having a generally cylindrical radially inner flange surrounding an exit opening and the flange being defined by a 300± 40 degree angle of arc;

the flange having a cutout portion being defined by a 60∓ 40 degree angle or arc; the peripheral wall, first wall portion, and second wall portion being made as a one piece unit and the flange having a notch portion disposed axially opposite to the projection with the projection having a mounting hole there through.

2. The dispenser of claim 1, wherein the peripheral wall has a wall cutout portion disposed adjacent to the flange cutout portion forming an overall cutout portion of L-shaped cross section.

* * * * *